United States Patent [19]

Flicker et al.

[11] 4,141,176

[45] Feb. 27, 1979

[54] POSABLE DOLL, MEANS FOR MOVABLY MOUNTING SAME AND TOY CAMERA

[75] Inventors: Alcwyn Flicker, Carson; Derek J. Gay, Rancho Palos Verdes; Tony Rhodes, Torrance; Roger H. Sweet, Long Beach, all of Calif.

[73] Assignee: Mattel, Inc., Hawthorne, Calif.

[21] Appl. No.: 832,456

[22] Filed: Sep. 12, 1977

[51] Int. Cl.[2] ..... A63H 13/04

[52] U.S. Cl. ..... 46/116; 46/1 R; 46/120; 46/175 R

[58] Field of Search ..... 46/116, 118, 119, 120, 46/121, 137, 138, 99, 107

[56] References Cited

U.S. PATENT DOCUMENTS

| | | | |
|---|---|---|---|
| 525,716 | 9/1894 | McElroy | 46/119 |
| 1,305,807 | 6/1919 | Kerr | 46/1 R |
| 1,685,358 | 9/1928 | Harcourt | 46/120 UX |
| 1,872,544 | 8/1932 | Williams | 46/120 |
| 2,137,371 | 11/1938 | Marsh | 46/120 |
| 2,602,265 | 7/1952 | Jackson | 46/175 |
| 2,637,936 | 5/1953 | Dale et al. | 46/120 |
| 2,853,832 | 9/1958 | Arena | 46/228 |
| 2,939,244 | 6/1960 | Grimes et al. | 46/175 |
| 3,090,158 | 5/1963 | Dixon | 46/228 |
| 3,147,566 | 9/1964 | Ong | 46/120 |
| 3,475,853 | 11/1969 | Adler | 46/120 |
| 3,490,171 | 1/1970 | Crawford et al. | 46/175 |
| 3,611,626 | 10/1971 | Bornn | 46/120 |
| 3,648,405 | 3/1972 | Tepper | 46/120 |
| 3,672,092 | 6/1972 | Tepper et al. | 46/137 |
| 3,757,463 | 9/1973 | Breslow et al. | 46/118 |

FOREIGN PATENT DOCUMENTS

| | | | |
|---|---|---|---|
| 1017578 | 9/1952 | France | 46/119 |

*Primary Examiner*—F. Barry Shay

*Attorney, Agent, or Firm*—John G. Mesaros; Max E. Shirk; Ronald M. Goldman

[57] ABSTRACT

In an apparatus for posing a doll, a platform is provided for supporting the legs of a doll and providing relative movement between the so-supported legs, the doll including means for moving the head in response to relative movement of the legs. The movement is accomplished by rotation of a lens member of a toy camera having a viewfinder through which the action can be observed to simulate a photography session.

18 Claims, 11 Drawing Figures

POSABLE DOLL, MEANS FOR MOVABLY MOUNTING SAME AND TOY CAMERA

BACKGROUND OF THE INVENTION

The background of the invention will be discussed in two parts:

FIELD OF THE INVENTION

This invention relates to toys and more particularly to a toy including a platform for posing a doll.

DESCRIPTION OF THE PRIOR ART

Dolls having pivotable and articulated members, commonly known as "fashion dolls" have become increasingly popular among children since the dolls can be posed in many ways to simulate real-life positions. Accessories for use with such dolls have likewise become very popular to create play settings where real-life action can be duplicated with respect to a given type environment, such accessories including doll houses, escalators, automobiles, horses and the like.

It is an object of the present invention to provide a new and improved accessory for use with a posable doll to simulate a photography session.

It is another object of this invention to provide a new and improved doll having a portion thereof movable in response to relative movement between the legs thereof.

It is a further object of this invention to provide a platform for supporting a doll and providing relative movement between the legs thereof for viewing through a toy camera.

SUMMARY OF THE INVENTION

The foregoing and other objects of the invention are accomplished by providing a platform for supporting the legs of a doll in a generally upright position, the platform having a disc-shaped member rotatable through a given angle by means of a cable operatively connected to the lens member of a toy camera, the disc member supporting one foot of the doll, the other leg thereof being retained by a leg supporting member rotatable about a fixed axis by a gear segment formed in the disc member. The doll has one leg thereof hingedly coupled about a fore-to-aft axis and the other leg thereof pivotable about a side-to-side axis, the legs being moved relative to each other with the doll mounted on the platform. The doll is provided with a member coupled to the pivotable leg member to rotate the head of the doll in response to pivoting of the leg member. Movement of the hinged leg member provides angular displacement between the longitudinal axis of the hinged leg member and the longitudinal axis of the torso of the doll, the cumulative effect of these movements resulting in the "posing" of the doll. This posing is viewed through the viewfinder of a toy camera which is provided with a manually-operable shutter which momentarily blocks the viewfinder to simulate the taking of a picture. The camera is further provided with a plurality of filters of different colors which can be positioned in the viewfinder.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
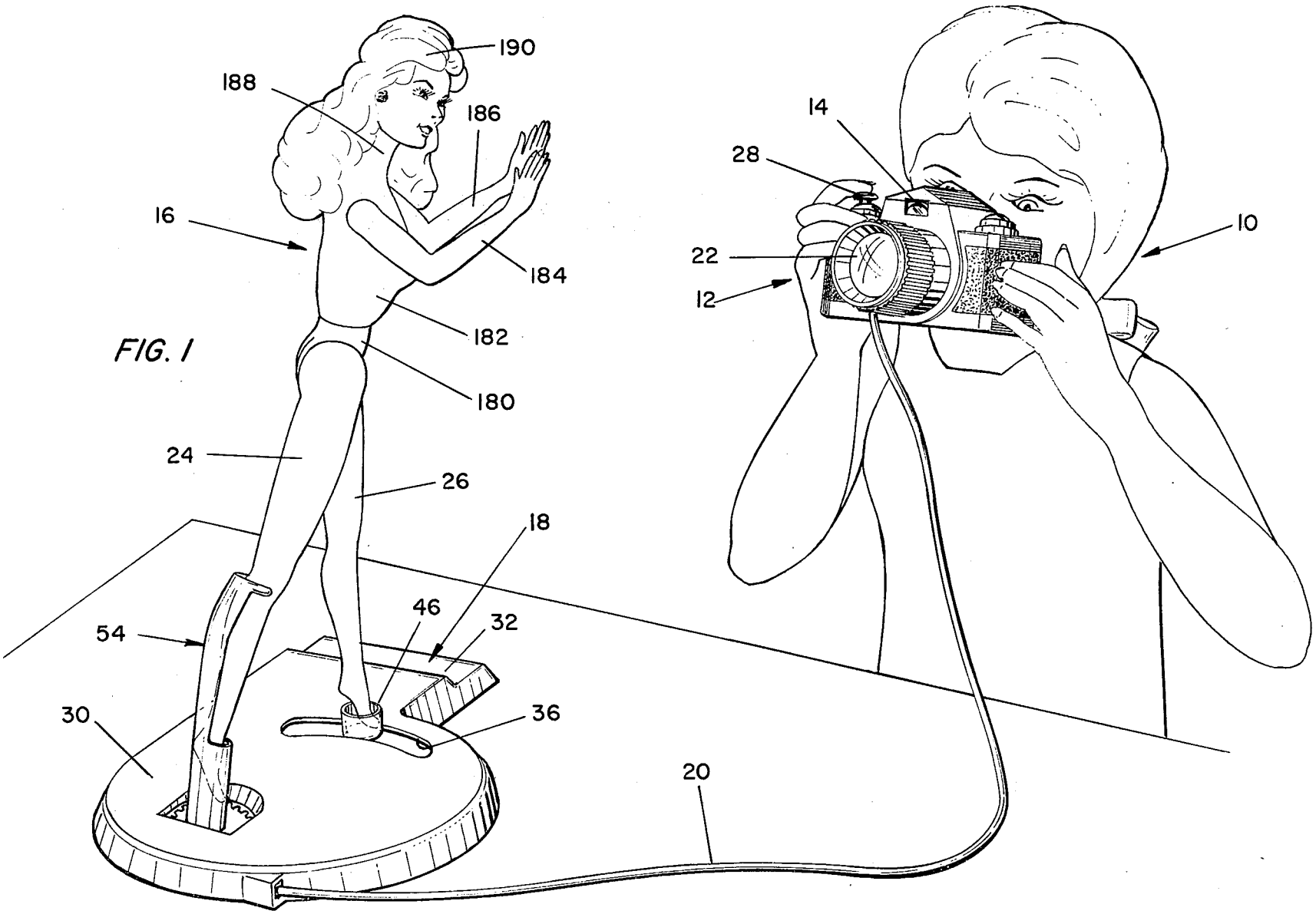
FIG. 1 is a perspective view illustrating a child using the apparatus for posing a doll according to the invention.

Referring now to the drawings and particularly to FIG. 1, there is shown a simulated photography session wherein a child 10 holds a camera generally designated 12, for viewing through the viewfinder 14 thereof, a doll generally designated 16 "posed" on a stage or platform, generally designated 18. Flexible interconnecting cable means 20 interconnect the lens 22 of the camera 12 with the platform 18. Generally, as will hereinafter be described, the doll 16 is an articulated fashion doll having movable and positionable portions or members. The leg members 24 and 26 are movable relative to each other, this relative movement being effected by the base or platform 18 on which the doll 16 is supported in a generally upright position. The cable means 20 interconnecting the platform 18 and lens 22 of the camera 14 has an outer stationary sheath with a cable 21 therein, the cable 21 being connected within platform 18 to suitable means for providing the relative movement between the legs 24 and 26. These means are actuated manually by the child 10 who views the doll 16 through the viewfinder 14 of the camera 12 and then rotates lens 22 which operates the cable means 20 until the doll 16 is suitably posed. The child then depresses a shutter button 28 on the camera 12, the actuation of the button 28 momentarily interposing a barrier within the viewfinder 14 to simulate actual photographing of the doll 16 as posed.

Figure 2:
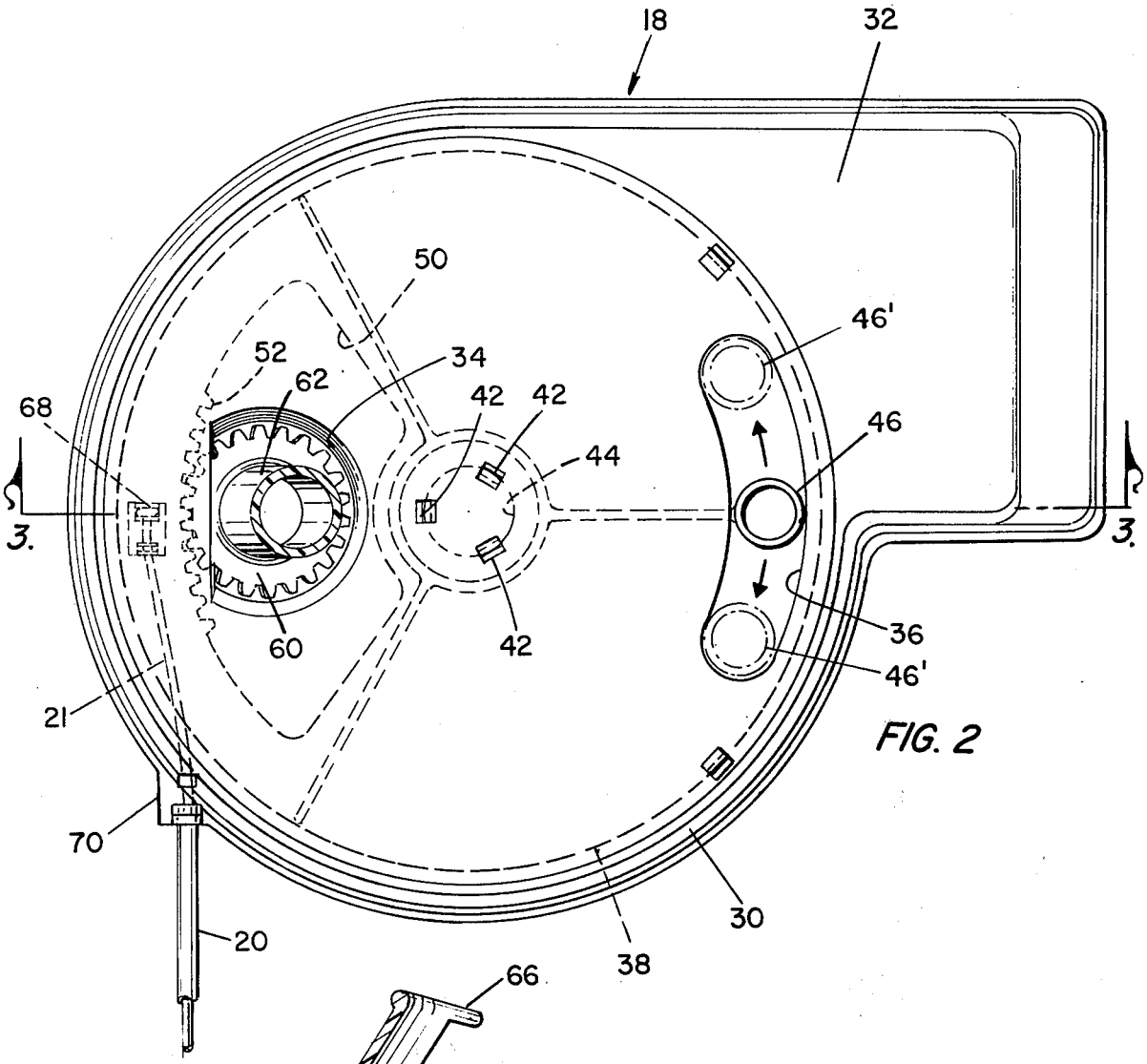
FIG. 2 is a plan view of the platform of the apparatus of FIG. 1 as viewed along line 2—2 of FIG. 3.
Figure 3:
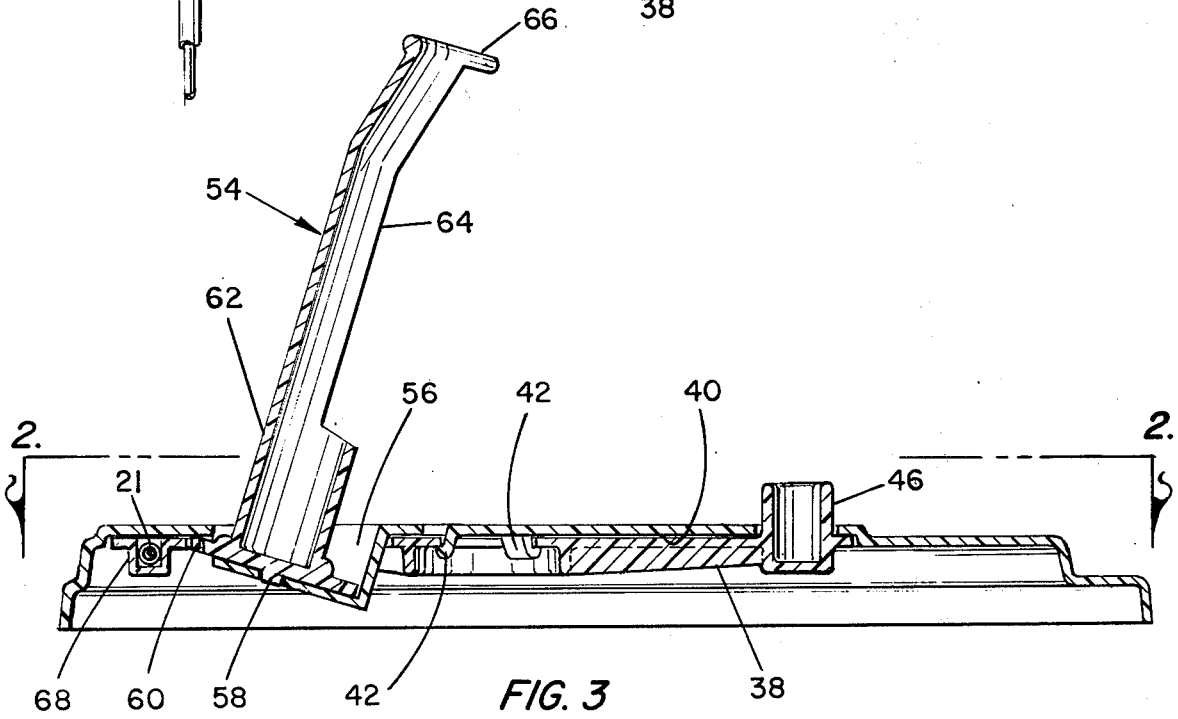
FIG. 3 is a cross-sectional view of the platform taken along line 3—3 of FIG. 2.
Figure 4:
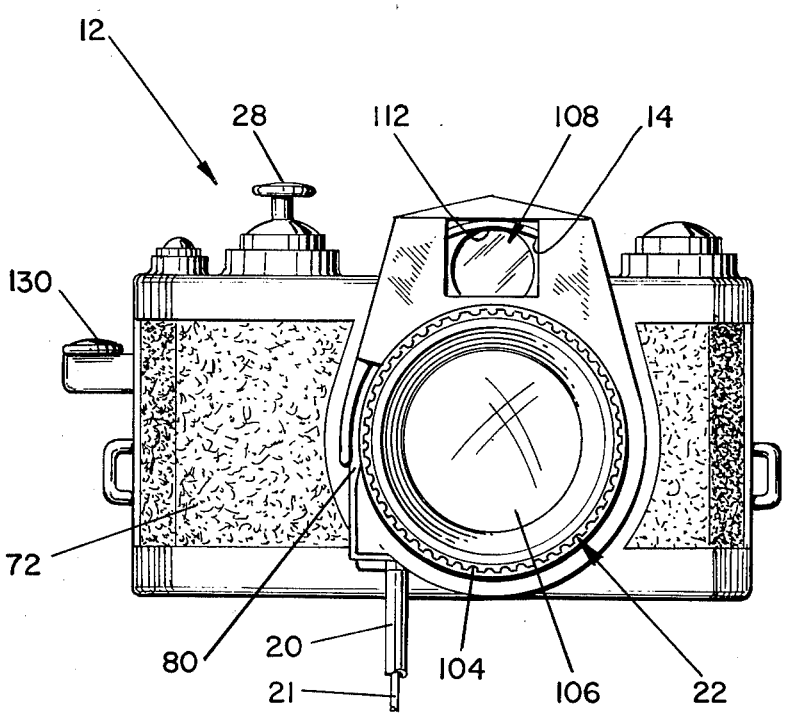
FIG. 4 is a front view of the camera used in the apparatus of FIG. 1.
Figure 5:
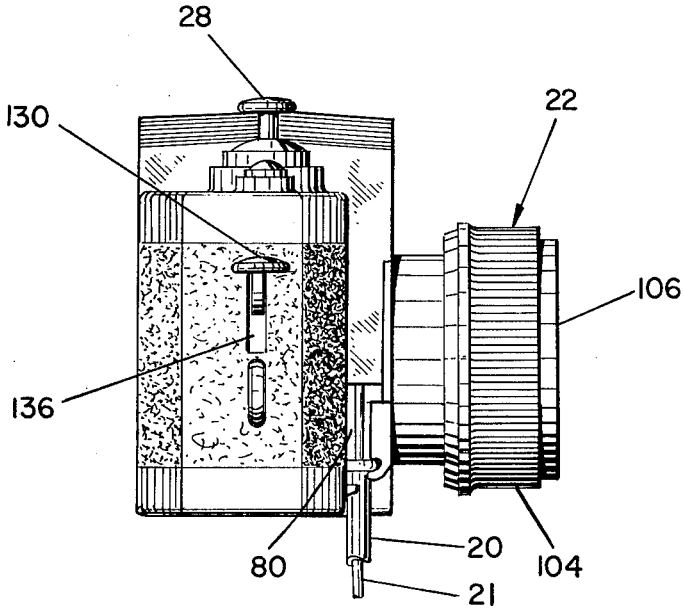
FIG. 5 is an end view of the camera of FIG. 4.

Referring now also to FIGS. 2 and 3, the platform 18 includes a housing structure having a circular inverted shallow circular shell portion 30 with an outwardly extending generally rectangular portion 32, the portions 30 and 32 being integrally formed to provide the housing with portion 32 serving as a stabilizing extended base. The platform 18 is configured for supporting on a suitable surface such as a table or the like with the overall configuration and size being sufficient to support the doll 16 in a generally upright position with the longitudinal axis of the doll generally vertical. The circular portion 30 is provided with an integral circular opening 34 and a peripheral arcuate slot 36, the slot 36 having the mid-point thereof diametrically opposite the opening 34. A movable generally disc-shaped member 38 is rotatably coupled within the housing within shell portion 30 with the upper surface of disc-shaped member 38 in sliding abutting relation with the planar undersurface 40 of circular shell portion 30. The undersurface 40 is provided with three equi-angularly disposed downwardly extending tangs 42 which are positioned the same distance from the center of the circular portion 30, the tangs 42 defining a circle which engages a circular aperture 44 centrally formed within the disc-shaped member 38. The disc-shaped member 38 is coupled within the circular shell portion 30 by snapping the aperture 44 of disc-shaped member 38 over the downwardly depending tangs 42. Extending upwardly from the surface of disc-shaped member 38 is a foot holding cup member 46 which is circular in cross section. The cup member 46 extends through arcuate slot 36 and is adapted to rotate along with disc-shaped member 38 through an angle defined by the extremities of slot 36, as indicated by the dotted line cup member 46'. Also formed in disc-shaped member 38 is a generally wedge-shaped opening 50 having an arcuate geartoothed segment on the periphery 52, the shape of opening 50 being configured for pivotal movement through an angle generally the same size as the angle defined by the slot 36, the geared periphery 52 of opening 50 suitably engaging a second leg supporting member 54 configured for engaging the leg 24 of the doll 16.

As best illustrated in FIG. 3, the circular opening 34 of the circular shell portion 30 has integrally formed therein a generally cup-shaped angularly disposed recess 56 which has leg supporting member 54 rotatably positioned therein for pivotal movement about its pivot axis 58 suitably secured to the bottom of recess 56 with the longitudinal axis of leg supporting member 54 disposed at an angle to the plane of the circular shell portion 30 of platform 18. The leg supporting member 54 has a bevelled gear portion 60 in meshing engagement with the gear periphery 52 of opening 50, with movement of the disc-shaped member 38 rotating the member 54 about a fixed pivot axis 58. The longitudinal axis of leg supporting member 54 remains stationary with respect to the upper surface of the circular shell portion 30 while the other foot holding cup member 46 moves or pivots within slot 36 to thereby provide relative movement between the legs 24 and 26 of the doll 16.

The leg supporting member 54 is provided with a cup-shaped foot receiving portion 62 at the lower end thereof extending upwardly from the gear member 60. Extending upwardly therefrom is a central arcuate spine portion 64 for abuttingly engaging the lower parts of the legs 24, while the upper free end of the leg supporting member 54 is provided with a horseshoe-shaped clip portion 66 for engaging the leg 24 just below the knee thereof.

To provide the pivotal movement of the disc-shaped member 38, the member 38 is provided with a cable receiving lug portion 68 depending downwardly from the undersurface of disc-shaped member 38. As shown in FIG. 2, the lug portion 68 is positioned approximately centrally with respect to the peripheral edge 52 of opening 50 and has secured therein one end of the cable 21 which passes through the sheath of cable means, the sheath having one end thereof secured within a suitable recess 70 formed in the periphery of circular shell portion 30, the recess 70 being in general alignment with the lug portion 68 to provide a generally straight line path for cable 21.

In operation, as will hereinafter be discussed, when the cable 21 is withdrawn into the sheath of cable means 20, the lug portion 68 engaging the free end of cable 21 is urged downwardly to rotate the disc member 38 in a counterclockwise direction as viewed in FIG. 2. As this counterclockwise direction commences, the upwardly extending foot holding cup member 46 rotates or pivots in a counterclockwise direction within arcuate slot 36. Simultaneously, the engagement of the peripheral gearteeth 52 of opening 50 engage the gear member 60 of the leg supporting member 54 to thereby rotate the leg supporting member 54 about its axis 58, likewise in a counterclockwise direction, without moving the leg supporting member 54 relative to its position on the platform 18. When the cup member 46 is thus moved to the end of arcuate slot 36 to the upper position shown in dotted lines and depicted 46', the cup-shaped member in this position is closer to the center of leg supporting member 54. With the foot holding cup member 46 in the solid line position, the distance between the centers of the gear portions 60 of leg supporting member 54 and the cup member 46 is the greatest since it is on a diameter extending through the center of the axis of rotation of the disc member 38. As the cup member 46 is angularly displaced to either end of the arcuate slot 36, the distance between these centers becomes less until the least distance between centers is obtained at either end of the arcuate slot 36. Consequently, during this pivoting of disc member 38, the legs 24 and 26 of the doll 16 are moved relative to each other to a greater or lesser distance depending upon the position of foot holding cup member 46. In addition, during this movement the leg supporting member 54 is rotated in the direction of movement of cup member 46 to thereby angularly displace the doll about its upright axis to change the position of the doll as viewed through the viewfinder 14 of the camera 12, for example, from a frontal view of the doll 16 to a three-quarter left, or three-quarter right view, depending upon the initial posing of the doll 16. The degree of pivoting or rotation of the doll 16 during the angular displacement of the disc member 38 is determined by the initial distance between the centers of the two foot supporting members as well as the diameter of and number of gearteeth of gear member 60, as well as the overall length of the gear peripheral edge 52 of the opening 50. Thus, a large amount of angular displacement can be effected by a small movement of the cable 21 within the sheath of cable means 20.

Referring now to FIGS. 4–9, the details pertaining to the construction of the camera 12 will be discussed. Briefly, the camera 12 includes a rotatable lens member 22 which is manually-operable with rotation thereof effecting the movement of the cable 21 within the sheath of cable means 20 to provide the displacement of the disc member 38 of platform 18 hereinabove discussed. Additionally, the camera 12 contains a shutter mechanism and a color filter wheel mechanism, each of which is independently manually-operable.

Figure 9:
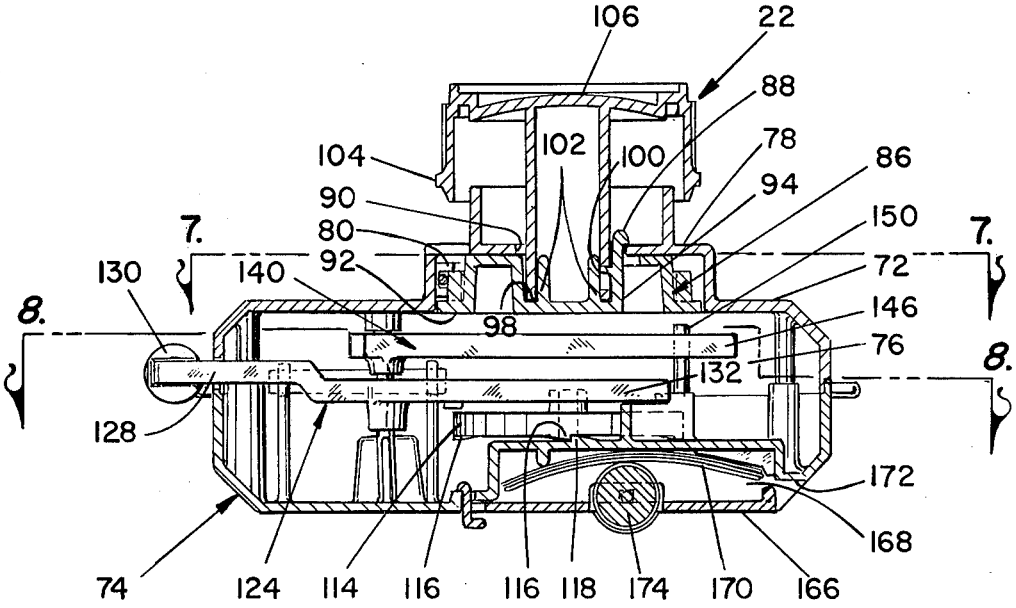
FIG. 9 is a cross-sectional view of the assembled camera of FIG. 4 as viewed generally along line 9—9 of FIG. 8.

As shown in FIG. 9, the camera 12 includes a front housing half 72 and a rear housing half 74 which are joined together along the edges thereof to form a component receiving compartment 76 therein. The front housing half 72 has an outwardly extending generally circular cup-shaped portion 78 formed therein extending outwardly from the main plane of the front housing half 72. The cup-shaped portion 78 is provided with a slotted opening 80 (see also FIG. 7), the portion 78 having integrally formed therein a suitable lug 82 for captively retaining the other end of the sheath of cable means 20, the cable 21 extending through the slotted opening 80 for engagement by a cable drive shoe member 84 which has an arcuate outer periphery conforming to the circular configuration of the inner portion of cup-shaped portion 78. Rotatably positioned within cup-shaped portion 78 is a drive wheel 86 having outwardly extending tang portions 88 snap fit to engage an aperture 90 formed in the front surface of a cup-shaped portion 78, the engagement being such as to permit rotation of the drive member 86. The drive member 86 has a main flange 92 of generally the same diameter as the inner diameter of the cup-shaped portion 78, the periphery of flange 92 being in spaced proximate relation to the interior periphery of portion 78. A circular wall portion 94 of drive member 86 has an outer diameter smaller than the diameter of flange 92 and has formed integrally therein a plurality of equi-angularly spaced, radially extending, projections 96 which extend partially across the width of flange 92 with the drive shoe 84 being configured for positioning between a pair of adjacent projections 96 for engagement thereby during rotation of drive member 86. The central portion of drive member 86 is provided with a pair of aligned diametrically opposed recesses 98 having tanged edges 100, the recesses 98 being adapted to receive the slotted prongs 102 centrally disposed with respect to the lens member 22 for retaining the lens member 22 in driving relation with drive member 86.

The lens member 22 is configured to simulate the actual lens of a camera and has a broad peripheral skirt portion 104 (see also FIGS. 4 and 5), configured to be gripped by the child 10 to thereby rotate the lens 22 and thus the drive member 86 to operate the cable 21. The frontal convex portion 106 of the lens 22 is formed integrally therewith, the lens member 22 being formed of a suitable plastic material which is opaque. All viewing through the camera 12 is done through the viewfinder 14.

Figure 6:
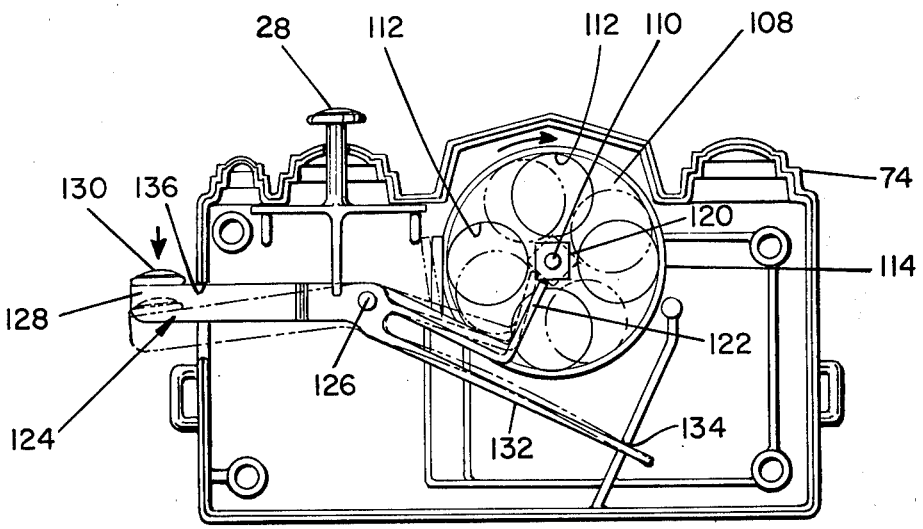
FIG. 6 is a front view of the interior of the rear half of the camera of FIG. 4 in a state of partial assembly with the filter wheel mechanism.
Figure 7:
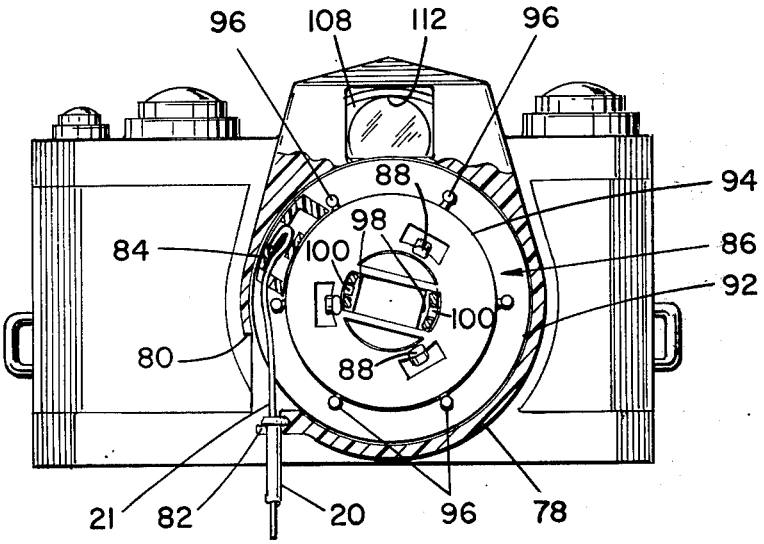
FIG. 7 is a front view of the camera similar to FIG. 4, partially broken away and partially in cross section to illustrate the connection and movement of the cable means.

Referring now to FIG. 6, the rear housing half 74 is shown from the interior thereof with a color filter wheel 108 rotatably mounted therein about an axis or shaft 110, the wheel 108 having four circular apertures 112 configured therein, each of the apertures 112 being adapted to align with the viewfinder 14. The wheel 108 has a peripheral rim 114, and as can be seen in end view in FIG. 9, the rim 114 has four equi-angularly positioned outwardly extending sawteeth 116 adapted to engage a matingly configured sawtooth 118 formed on the interior of rear housing half 74. The central portion of filter wheel 108 is provided with a square shank 120, the corner of the shank 120 being configured for selective engagement by an actuating arm 122 of a color filter wheel lever generally designated 124. The lever 124 is formed from a flexible plastic material and is pivotally mounted about a pivot axis 126 formed within the interior of rear housing 74, the pivot shaft 126 being at the approximate mid-point of the overall length of lever 124. Extending outwardly from axis 126 is an actuating arm 128, the free end of which has a suitable button 130 externally of the camera for depression in the downward direction as the arrow indicated thereabove to the dotted line position shown in FIG. 6. Extending in the opposite direction from actuating arm 128, the leverl 124 has a first resilient leaf member 132, the free end of which engages a shoulder 134 formed within the housing 74. During assembly, the leaf member 132 is slightly deformed downwardly as viewed in FIG. 6 to engage the shoulder 134 to thereby resiliently urge the actuating arm 128 in an upward direction against an abutment 136 which is part of a slot formed in the side of housing 74. Extending generally parallel to leaf member 132 is an integral actuating arm 122 which is generally L-shaped, the free end of which urges against a bottom corner of one of the sides of the square shank 120. Upon depression of the button 130 of the lever 124 downwardly until the lever 124 is in the dotted line position, the free end of actuating arm 122 urges against the corner of shank 120 thereby rotating it clockwise with the apertures 112 of the filter wheel 108 shown in an intermediate position during this movement. During this time, the leaf member 132 is being deformed to the dotted line position shown adjacent thereto until, with a full movement of the lever 124, the following aperture 112 is in the position shown in solid lines for viewing therethrough by the child 10. The position of filter wheel 108 is detented by means of the sawteeth 116 and 118 previously referred to. The color filter wheel 108 has the apertures 112 thereof suitably enclosed with transparent film, preferably of different color for each of the apertures 112, thereby simulating the filter arrangement of a conventional camera.

Figure 8:
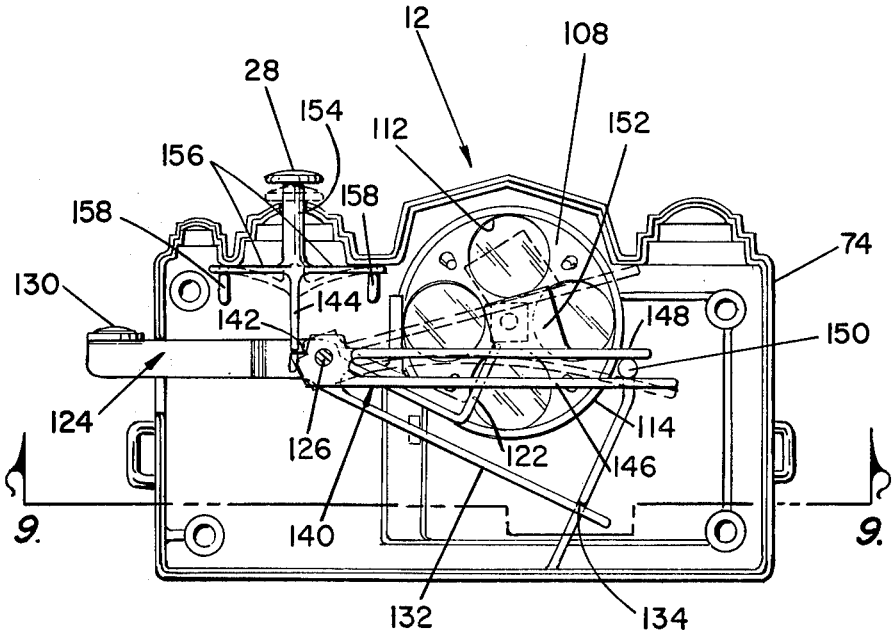
FIG. 8 is a front view of the rear half of the camera similar to FIG. 6 with the shutter mechanism assembled therein as viewed generally along line 8—8 of FIG. 9.

Referring now to FIG. 8, the next component assembled onto the shaft 126 within rear housing 74, is the shutter assembly generally designated 140. The shutter assembly 140 is a unitary member pivotally mounted about shaft 126 at one end thereof, this end of shutter assembly 140 being configured to provide a step 142 in alighment with the shutter actuating rod 144 of the shutter button 28. Extending outwardly from this end of shutter assembly 140 is a pair of parallel bar-shaped members 146 and 148, the terminal ends of which are positioned on either side of a stop boss 150. The shutter assembly 140 is one-piece and formed of a resilient plastic which enables bar-shaped member 146 to act as a leaf spring to bias the assembly to the position shown in solid lines. Formed integrally with the upper edge of bar-shaped member 148 is an upwardly extending angularly displaced shutter blade 152 which has an overall size and configuration to suitably block the circular aperture 112 of wheel 108 in alignment with the viewfinder 14. The shutter button 28 has an enlarged button head with a trunk portion 154 of circular cross section extending through an opening in the housing, the lower edge of trunk portion 154 having a pair of diametrically opposed transversely extending leaf spring portions 156 suitably retained by integral ridges 158 formed on the interior of rear housing 74. Extending in depending aligned relation with the trunk portion 154 is the actuating pin 144.

In operation, when shutter button 28 is depressed downwardly the free end of shutter actuating pin 144 engages step 142 of the shutter assembly 140 to thereby rotate the bar-shaped member 148 in a counterclockwise direction thereby positioning shutter blade 152 over aperture 112 to thereby block the view through the viewfinder 14. This action is illustrated in dotted lines in FIG. 8. As the shutter button 28 travels downwardly an additional increment, the free edge of shutter pin 144 passes over the step 142 due to the flexibility of shutter pin 144, thereby permitting the shutter blade 152 to return to its solid line position shown in FIG. 8. The single depression action thereby momentarily blocks and unblocks the view through the viewfinder 14 to simulate the action of a conventional camera.

Referring now to FIG. 9, in order to further simulate the action of a camera, the rear housing 74 has an openable hinged cover member 166 closing a shallow compartment 168 which has positioned therein a plurality of stacked preprinted cards 170 which can be ejected through a slot 172 in one end of the camera adjacent the edge of the cover 166. The cards 170 are discharged individually by means of a rubber or plastic edged wheel 174 rotatably mounted on the cover 166, the edge of the wheel 174 being adapted, upon rotation thereof, to frictionally engage and individually eject the preprinted cards 170.

Figure 10:
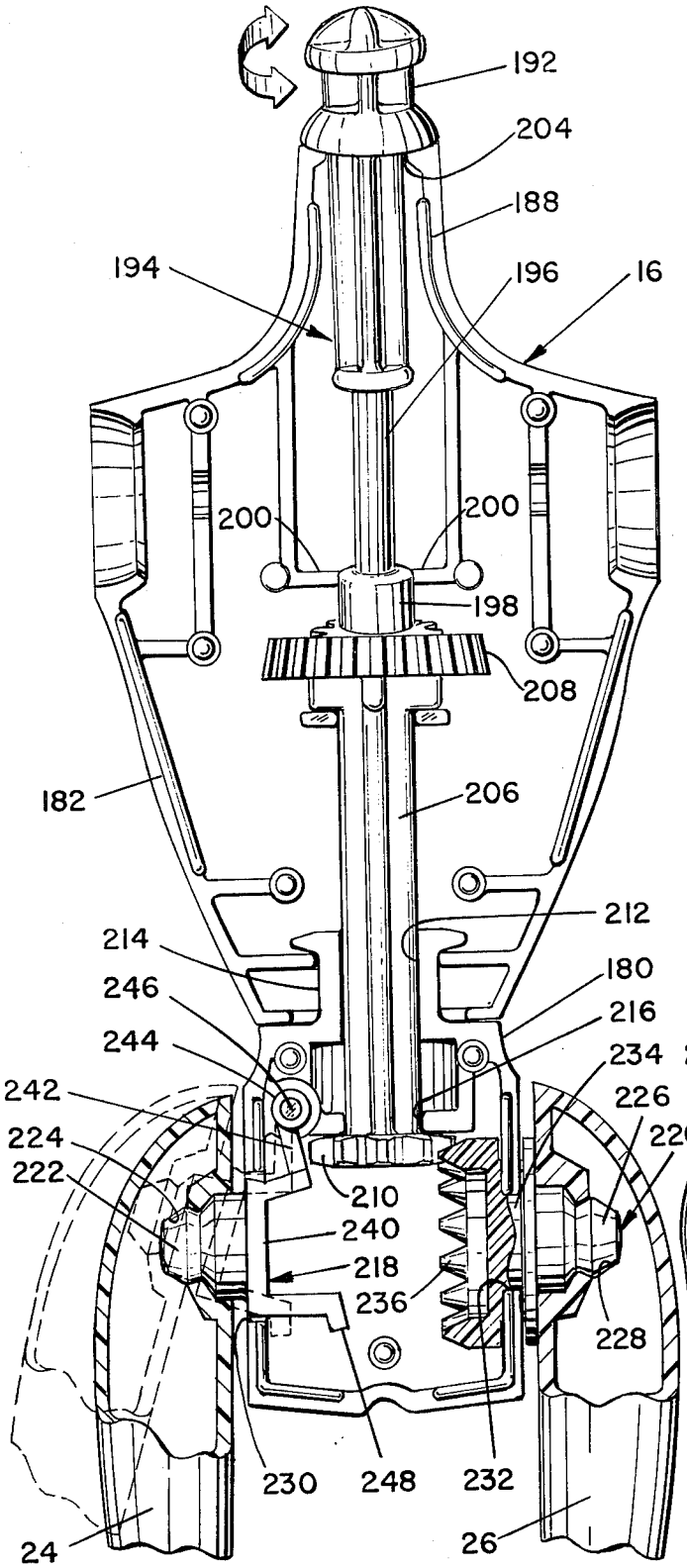
FIG. 10 is a front view of the interior of the rear halves of the torso members of the doll of FIG. 1 with the upper portions of the legs thereof shown partially in cross section to illustrate the moving components of the doll.
Figure 11:
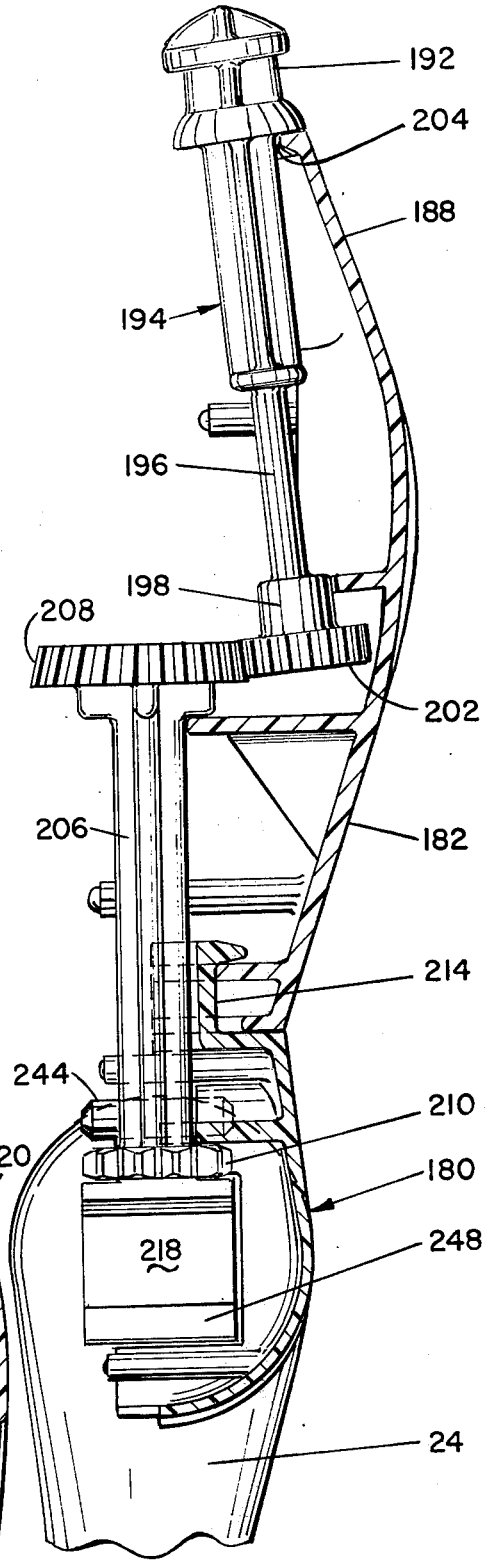
FIG. 11 is a partial cross-sectional side view of the mechanism of FIG. 10 as viewed from the right side thereof.

Referring now to FIGS. 1, 10 and 11, the doll construction details will be discussed. As shown in FIG. 1, the doll 16 has a torso including a lower torso member 180 and an upper torso member 182 coupled for pivotal movement about the longitudinal axis of the doll. Posable and bendable arms 184 and 186 are pivotally secured to the shoulder portion of the upper torso 182 which terminates in an upwardly extending neck portion 188 to which is secured a head member 190. As shown in FIGS. 10 and 11, the head has been removed but the head is secured by frictional engagement with the enlarged end 192 of a head pivoting member generally designated 194. The head 190 is provided with an opening frictionally engaging the end 192 to permit rotation of the head 190 with respect to the end 192 for pre-posing the head, while allowing rotation of the head 190 concurrently with end 192 during operation of the toy. The member 194 has a main elongated shaft portion 192 with the lower end thereof having an enlarged circular bearing portion 198 captively rotatably retained by means of bearing portions 200 formed on the interior of the upper torso 182. Below the bearing portion 198 is an enlarged bevelled gear member 202. The upper end of shaft portion 196 extends through an opening 204 in the neck portion 188 of the upper torso 182, the opening 204 rotatably receiving the upper end of shaft portion 196. Enlarged end 192 is mushroom-shaped and configured to suitably receive an opening in head 190 in frictional engagement for rotation of the head 190 concurrently with shaft 196.

An intermediate member 206 is rotatably positioned within the doll 16, the member 206 being a generally elongate shaft having a bevelled gear 208 at one end thereof in meshing engagement with the bevelled gear 202 and having a second gear member 210 at the other end thereof within lower torso 180. The shaft of member 206 is rotatably coupled through an aperture 212 formed in a cylindrical extension 214 of the lower torso 180, the extension 214 being configured for coupling the upper torso 182 to the lower torso 180 to thereby permit relative rotational movement between the upper and lower torso members 182 and 180, respectively.

The lower torso 180 is provided with an integrally formed ribbed portion to form a second bearing surface 216 for supporting the lower gear 210 of member 206 in general vertical alignment along the longitudinal axis of the doll 16. As can be seen in FIGS. 10 and 11, the head pivoting member 194 is angularly disposed with respect to the longitudinal center axis extending through the intermediate shaft member 206 with the bevelled gear 202 being rearwardly disposed from the bevel gear 208. This angular inclination of head pivoting member 194 places the longitudinal center line thereof in a slightly forwardly inclined position so that with head member 190 positioned on the enlarged end 192 thereof the head will be canted slightly forward.

Within the hollow interior of lower torso 180 leg member supporting means are provided for legs 24 and 26. These leg member supporting means include a hinge member 218 and a rotatable member generally designated 220, the hinge member 218 having an outwardly extending boss 222 adapted to pivotally engage a matingly configured recess 224 within leg 24. Similarly, in alignment with boss 222, the rotatable member 220 is provided with a boss 226 for matingly engaging a recess 228 formed within the upper end of leg member 26, the bosses 222 and 226 being in general axial alignment with each other.

The lower torso 180 is provided with a rectangular opening 230 through which the leg pivoting member 218 passes. The other end of lower torso 180 is provided with a circular aperture 232 into which is inserted the bearing portion 234 of rotatable member 220. Integrally formed with rotatable member 220 and positioned internally within torso member 180 is an enlarged diameter gear member 236 which has the teeth thereof positioned about the periphery thereof and extending in a direction perpendicular to the plane of rotation of the member 220. The teeth of gear 236 are configured to engage the gearteeth of gear member 210 to provide rotation of intermediate shaft member 206 about its axis which is generally perpendicular to the axis of rotation of rotatable member 220, to thereby convert rotation about one axis into rotation about a second axis mutually perpendicular to the first axis. The leg member 26 is thus rotatably coupled for pivotal movement about a side-to-side axis, that is, an axis extending through the hip portions or sides of the lower torso 180.

The other leg member 24 is coupled to member 218 for hinged or pivotal movement about a fore-to-aft axis, that is, an axis extending from the front to rear of the lower torso 180, this axis being mutually perpendicular to the side-to-side axis. The hinge member 218 has a generally planar portion 240, which in the normal position shown in solid lines, is generally coextensive with the adjacent planar edge of the lower torso 180 with the boss 222 extending generally perpendicular thereto and outwardly therefrom. Extending inwardly and upwardly from the planar portion 240 is a hinge arm portion 242 having a circular hinged end 244 formed integrally therewith, the hinged end 244 having an aperture extending therethrough for mounting on a shaft 246 for pivotal movement about the fore-to-aft axis or shaft 246. The lower end of member 218 is configured inwardly with a downwardly depending angularly inclined lip portion 248 which serves as a pivot stop when the inner edge of lip 248 engages the interior edge of torso 180 adjacent the opening 230.

With the head member 190 positionally fixed on the enlarged end 192 of the head pivoting member 194, as leg 26 is rotated or pivoted, the member 220 pivots concurrently therewith thereby rotating the gear member 236 which is in meshing engagement with the gear member 210 of intermediate shaft member 206. Rotation of shaft member 206, through the coupling of its bevel gear 208 with the bevel gear 202 rotates the head pivoting member 194 to thereby result in another portion of the doll 16 being moved in response to relative movement of the leg members 24 and 26. In this particular instance, the other portion which is being moved is the head 190.

As previously discussed, when the doll 16 (see FIG. 1) is mounted on the platform 18 with the foot of leg 26 within the foot holding cup member 46 and the leg member 24 being suitably retained by leg supporting member 54, the distance between the two feet of the doll 16 changes as the disc-shaped member 38 is rotated or pivoted in response to rotation of the lens 22 of the camera 12 by the child 10. This changing of the spacing between the feet of the doll 16 is accommodated by the hinged member 218 to which the leg member 24 is coupled.

Due to the hinged connection of leg member 24 to the torso to accommodate side-to-side relative movement, and the pivotable connection of leg member 26 to accommodate front to rear relative movement, the net result is a compound movement of the doll 16 with respect to the platform 18 as the doll 16 has the leg members 24 and 26 moved relative to each other. Initially, referring to FIGS. 1, 10 and 11, with the child 10 viewing the doll 16 through the viewfinder 14 in the position illustrated in FIG. 1, as the lens member 22 is rotated to effect a movement of the leg 26 forwardly, the pivoting movement of leg member 26 rotates intermediate gear member 206 counterclockwise (as viewed from the top in FIG. 10) thereby rotating head pivoting member 194 along with head 190 in a clockwise direction, that is, the head 190 as viewed in FIG. 1, will turn away from the view of the child 10. The head 190 rotates with respect to the torso when the leg 26 pivots with respect to the torso, the ratio of movement of the head to the leg being approximately three to one; that is, a ten degree pivoting of the leg with respect to the lower torso 180 will result in a thirty degree pivoting of the head 190 with respect to the upper torso 182. Conversely, if the leg 26 is pivoted rearwardly with respect to leg member 24, this will result in a turning of the head 190 in the clockwise direction, that is, toward the view of the child 10. The gear coupling arrangement is such that the upper torso member 182 can be pivoted with respect to the lower torso member 180 without affecting the positional relationship of the interconnecting gear members 194, 206 and 236. With the leg member 26 in a fixed position relative to leg member 24, the head 190 will remain fixed in its position relative to the lower torso member 180 as the upper torso member 182 is rotated. With the opening in the head 190 frictionally engaging enlarged mushroom-shaped end 192 of head pivoting member 194, the head 190 can be rotated relative to the end 192 for prepositioning of the head 190 with respect to the child 10 prior to actuation of the platform 18 as hereinabove described.

In addition to the pivoting of the head 190 during relative displacement of the leg members 24 and 26, the angular position of the longitudinal axis of the two-part torso changes relative to the longitudinal axis of leg member 24 due to the hinged relationship between leg member 24 and lower torso member 180. As viewed from the front of FIG. 10, the solid line position of leg member 24 depicts the leg member 24 in its normal position relative to the two-part torso, with the long axis of leg member 24 extending on a line generally parallel with the intermediate gear member 206. During movement of the doll 16 when positioned on platform 18, the leg 24 extends outwardly to the dotted line position, thereby angularly displacing the longitudinal center line or axis of the leg member 24 with respect to the longitudinal axis or center line of the two-part torso. With the hinged leg member 24 fixed in a relatively stationary position due to the overall length of leg supporting member 54, this angular displacement results in a tilting of the longitudinal center line of the torso toward or away from the longitudinal center line of the leg member 24 thus providing movement of the doll torso relative to the leg member 24 during rotation of the disc member 38. The hinge member 218 to which leg member 24 is coupled permits a tilting of the body or torso through an angle of approximately fifteen degrees as viewed from the front in FIG. 10. Due to the fixed position of the fore-to-aft axis 246, the hinge member 218, and consequently leg member 24, are constrained to one direction of relative movement, that is, the leg 24 can only move from side-to-side relative to the lower torso member 180. As viewed from the side of the doll 16, the longitudinal center line of the leg 24 maintains a fixed position relative to the longitudinal center line of the two-part torso.

On the other hand, the pivotal leg member 26 has one degree of freedom about its pivot axis extending through the center of rotatable member 220, this axis extending from side-to-side through lower torso 180. As viewed from the front in FIG. 10, the longitudinal center line of the let member 26 remains generally parallel to the longitudinal center line of the two-part torso of the doll 16. As viewed from the side, the longitudinal center line of the leg member 26 is disposed angularly with respect to the longitudinal center line of the two-part torso of the doll 16. Thus, during rotation of the disc-shaped member 38 of platform 18, the angular position of the leg member 26 will be varied in a front to rear plane with respect to the doll torso. Each leg thereby provides movement with respect to the longitudinal center line of the torso in an angular direction mutually perpendicular to the direction of displacement of the other leg.

As a net result, this construction provides compound movement in four different ways with the doll 16 mounted on the platform 18 as viewed in FIG. 1. In the first movement, the head 190 rotates relative to the upper torso 182 when the leg members 24 and 26 are displaced relative to each other. In a second motion, the longitudinal center line of the hinged leg member 24 is being displaced angularly relative to the longitudinal center line of the two-part torso of the doll 16, as viewed from the front of the doll 16. This movement occurs as the foot holding cup member 46 traverses slot 36 thereby changing the lateral spacing between the feet of leg members 24 and 26 as previously discussed. A third direction of motion occurs as a result of the pivoting of leg member 26 relative to the two-part torso of doll 16 during traversal of the foot holding cup member 46 within slot 36. A fourth degree of motion is obtained on an overall basis when the child 10 is viewing the posing of the doll 16 through the viewfinder 14, the child 10 then rotating the lens member 22 to effect the traversal of foot holding cup member 46 within slot 36. This degree of motion results from the changing of the angular position of leg member 24 relative to platform 18 by means of the gear coupling (see FIGS. 2 and 3) effected between the geartooth segment 52 coacting with the gear member 60 of leg supporting member 54, this gear coupling changing the overall facing direction of the doll 16 relative to the platform 18. By reference to FIGS. 1 and 2, as the disc-shaped member 38 is rotated clockwise to the dotted line position 46', as shown adjacent the lower edge of arcuate slot 36, the gear member 60 also rotates clockwise, thus rotating leg supporting member 54 clockwise to effectively reposition the entire doll 16 in a clockwise direction, this angular displacement of the doll 16 relative to the platform 18 having the amount thereof determined by the ratio of the diameter of gear member 60 to the diameter of the gear segment 52.

In operation of the toy of FIG. 1, the child 10 positions the doll 16 by placing the right foot of leg member 24 for captive retention within the cup-shaped foot receiving portion 62 of leg supporting member 54, the child then engaging clip portion 66 just below the knee of leg member 24. The left foot of leg member 26 is then positioned within foot holding cup member 46 for concurrent movement therewith. The child 10 then poses the doll by positioning the arms 184 and 186, by rotatably positioning the upper torso 182 with respect to lower torso 180 and also by rotating head member 190 relative to the enlarged end 192 of head pivoting member 194, member 194 remaining stationary during this rotation. The child 10 views the doll 16 through the viewfinder 14 of camera 12, and then rotates lens 22 which rotates disc-shaped member 38 to displace leg members 24 and 26 relative to each other as the foot holding cup member 46 is moved within slot 36 of platform 18. Simultaneously, with the movement of foot holding cup member 46, the leg supporting member 54, as well as leg member 24, is rotated in the direction of movement of member 46. As this movement occurs, the two-directional relative displacement of the legs 24 and 26 rotates the head 109 of the doll 16 while simultaneously repositioning the doll 16 relative to the platform 18 to present more or less of a frontal view of the doll 16 for viewing through the viewfinder 14. Additionally, the changing of the lateral spacing between the foot members of the leg members 24 and 26 tilts the two-part torso by relative angular displacement of the lower torso 180 with respect to the hinge member 218 resulting in animated compound posing motion of various parts of the doll relative to each other, and of the doll 16 relative to the platform 18.

When the child 10 suitably poses the doll 16, the child has the option of selectively interposing a different color filter into the viewfinder path by rotation of the filter wheel 108. The child can then depress the shutter button 28 to momentarily interpose the shutter blade 152 into the path of the viewfinder 14 to thereby simulate the clicking picture-taking operation of a conventional camera. Thus, there has been shown and described a toy in which the child 10 can pre-pose the doll 16 on platform 18 in a multitude of original positions, with each of the positions being adjustable by means of rotation of the lens 22 of the camera 12 while viewed through the viewfinder 14. In addition, due to the flexible nature of the cable means 20, the child 10 can view the doll 16 at different locations resulting in a multiplicity of viewed, posed positions being available for viewing through different colored filters.

While there has been shown and described a preferred embodiment, it is to be understood that various other adaptations and modifications may be made within the spirit and scope of the invention.

What is claimed is:

1. In a toy, the combination comprising:

a doll having a torso with a pair of leg members connected thereto, at least one of said leg members being movable with respect to the other, said torso having at least one other portion attached thereto in relatively movable relation ;

means within said doll for moving said one other movable portion in response to relative movement of said at least one leg member;

a base having means for supporting the leg members of said doll with said doll in a generally upright position;

means within said base coupled to said leg member supporting means for moving said leg member support means and thus providing relative movement between said leg members;

a camera having manually-operable means; and means interconnecting said manually-operable means and said base for actuating said means within said base for moving said at least one other portion of said doll in response to actuation of said manually-operable means whereby to simulate the posing of the doll for the photographing thereof.

2. The combination according to claim 1 wherein said base includes a housing having a platform and said means within said base includes a pivotable member coupled within said housing for movement relative to said platform, one of said leg member supporting means being coupled to said platform and the other of said leg member supporting means being secured to said pivotable member.

3. The combination according to claim 2 wherein said doll has a first leg member coupled for pivotal movement about a side-to-side axis and the other leg member is pivotable about an axis perpendicular to said fore-to-aft axis.

4. The combination according to claim 3 wherein said pivotable member is coupled relative to said platform for angularly displacing said first leg member relative to the longitudinal center line of said doll in a first direction and for angularly displacing said other leg member relative to the longitudinal center line of said doll in a second direction generally perpendicular to said first direction during movement of said pivotable member relative to said platform for tilting the doll while simultaneously moving said at least one other portion of said doll.

5. The combination according to claim 4 wherein said pivotable member is a disc member, said other leg member supporting means is a generally cup-shaped foot receiving member secured to said disc member and said one of said leg member supporting means is rotatably coupled to said platform.

6. The combination according to claim 5 wherein said one of said leg member supporting means includes a gear portion and said disc member includes a gear segment in meshing engagement with said gear portion for rotating said one leg member supporting means in response to pivotal movement of said disc member.

7. The combination according to claim 5 wherein said one leg supporting means is a leg supporting member having a first portion for receiving the foot of the leg member and a second portion for at least partially gripping the leg member below the knee portion thereof.

8. The combination according to claim 7 wherein said at least one other movable portion of said doll is a head member.

9. The combination according to claim 8 wherein said means within said doll includes gear means interconnecting said first leg member and said head member.

10. The combination according to claim 9 wherein said doll includes upper and lower torso members coupled for relative movement with respect to each other.

11. The combination according to claim 10 wherein said manually-operable means of said camera is a rotatable lens member.

12. The combination according to claim 11 wherein said interconnecting means is a flexible cable having the other end thereof secured for moving said pivotal member.

13. The combination according to claim 12 wherein said camera includes a view finder and a manually-operable simulated shutter mechanism to simulate the photographing of said doll.

14. In a toy, the combination comprising:

a doll having upper and lower torso members connected for rotation relative to each other about the longitudinal center line of the so-connected torso members;

a first leg member secured to said lower torso member for pivotal movement about a side-to-side axis to angularly displace said first leg member in a first direction relative to said longitudinal center line;

a second leg member coupled to said lower torso member about a fore-to-aft axis for angularly displacing said second leg member relative to said longitudinal center line in a second direction generally perpendicular to said first direction;

a head supporting member rotatably mounted in said upper torso member;

means within said torso members for rotating said head supporting member in response to pivotal movement of said first leg member;

a base member having means for receiving portions of said leg members for supporting said doll in a generally upright position; and means within said base member for providing, through movement of said leg receiving means, relative displacement between said leg members in said first direction and in said second direction for tilting the longitudinal center line of the torso members relative to said second leg member and for rotating said head supporting member in response to pivotal movement of said first leg member.

15. The combination according to claim 14 wherein said means for receiving portions of said leg members includes a generally cup-shaped member for receiving the foot portion of said first leg member and a leg supporting member for receiving a portion of said second leg member.

16. The combination according to claim 15 wherein said base member includes a housing and said means within said base member includes a disc member rotatably coupled to said housing, said cup-shaped member being secured to said disc member and said leg supporting member being rotatably coupled to said housing with means interconnecting said leg supporting member and said disc member for providing rotation of said leg supporting member in response to rotation of said disc member.

17. The combination according to claim 16 wherein said toy includes other means for actuating said means within said base member.

18. The combination according to claim 17 wherein said other means includes a toy camera having a manually-operable portion and means interconnecting said manually-operable portion and said means within said base member.

* * * * *